United States Patent [19]

Johnson

[11] 4,277,215

[45] Jul. 7, 1981

[54] ARTICULATE MATERIAL TRANSFER SYSTEM

[75] Inventor: Weldon K. Johnson, Boise, Id.

[73] Assignee: Kerr-McGee Coal Corporation, Oklahoma City, Okla.

[21] Appl. No.: 81,887

[22] Filed: Oct. 4, 1979

[51] Int. Cl.[3] ..... B65G 65/32; B61D 7/30

[52] U.S. Cl. ..... 414/292; 414/303; 414/387; 105/241.2; 105/308 R

[58] Field of Search ..... 414/292, 303, 387; 105/241.2, 308 R

[56] References Cited

U.S. PATENT DOCUMENTS

| | | | |
|---|---|---|---|
| 2,399,708 | 5/1946 | Sanford | 414/387 |
| 2,487,447 | 11/1949 | Kepner | 414/387 |
| 2,679,324 | 5/1954 | Cannon | 414/303 |
| 3,227,100 | 1/1966 | Smith et al. | 414/387 X |
| 3,543,691 | 12/1970 | Nagy | 105/241 C |
| 3,633,772 | 1/1972 | Miller | 414/387 |

*Primary Examiner*—Robert G. Sheridan

*Attorney, Agent, or Firm*—William G. Addison

[57] ABSTRACT

An improved system for automatically transferring particulate material, such as coal, is provided wherein the particulate material is transferred from a railroad car into an underground storage bunker while maintaining the material in a substantially covered or protected condition.

39 Claims, 10 Drawing Figures

ARTICULATE MATERIAL TRANSFER SYSTEM

BACKGROUND OF THE INVENTION

1. Field of the Invention

The present invention relates generally to systems for transferring particulate materials, and, more particularly, but not by way of limitation, to systems for transferring particulate material, such as coal from railroad cars into an underground storage bunker, while maintaining the particulate matter in a substantially covered or protected condition.

2. Description of the Prior Art

In prior art systems, the material is not covered substantially continuously during an unloading operation. Thus, the particulate material is exposed to moisture or water (in the form of rain, snow, and the like) or blowing dust and debris. This is particularly undesirable when the particulate matter being transferred is in a dried or purified form.

In the past, some drop-bottom railroad cars were constructed having downwardly swinging doors. Such devices are disclosed in U.S. Pat. Nos. 2,399,708, issued to H. W. Sanford, and 2,487,447, issued to R. C. Kepner. In the prior art systems, as set forth above, the mechanisms utilized to unlatch and relatch the downwardly swinging doors were positioned between the track rails above a storage bunker. Thus, as the railroad car was moved over the storage bunker, the unlatching mechanism was engaged by the door latch, thereby allowing the door to swing downwardly. The material was then delivered from the railroad car through the opened bottom-drop door. To relatch the doors, each car had to be moved in a reverse direction over the relatching mechanism.

Other unloading systems are disclosed in U.S. Pat. Nos. 3,227,110, issued to J. T. Smith, et al.; 3,543,691, issued to Ernest J. Nagy; and 3,633,772, issued to Roy W. Miller. In general, the systems disclosed in such patents permit the railroad cars to be moved over the length of a storage bunker without the necessity of moving each car in the reverse direction over a relatching mechanism. Such systems utilized cam tracks positioned between or near the side of the track rails and compatible cam followers connected to the drop-bottom doors on each railroad car.

SUMMARY OF THE INVENTION

The present invention contemplates a particulate material transfer system for automatically unloading the particulate material from a railroad car to an under-the-track storage bunker. During the unloading operation, the particulate material is substantially continuously covered, thereby protecting such material from the detrimental effect of the surrounding outside environment.

The system of the present invention allows a train of the vehicles to maintain an efficient traveling rate during the unloading operation. In addition, the present system functions in a substantially automated manner and thus the number of personnel required to operate the present system is substantially reduced.

DESCRIPTION OF THE PREFERRED EMBODIMENT

In the course of unloading processed particulate material, such as dried coal and purified chemicals, it is often desirable and sometimes imperative that the material be maintained in a covered condition. In this manner, the material remains protected from the surrounding environment (rain, snow, sleet, dust and blowing debris). If the particulate material is not maintained in a protected or covered position, or is exposed to the effects of adverse weather conditions, the material could become contaminated or otherwise reduced to an unstable state. In any event, the material might have to be reprocessed or, at least, allowed to dry which would result in additional expenditure of time and money.

Processed particulate material, such as generally referred to above, often is transported by transport vehicles, such as railroad cars. By coupling a number of such vehicles together in the form of a train, relatively large quantities of processed particulate material can be transported from one location to another for storage. In such instances, the particulate material is loaded into the vehicles (or railroad cars) by an overhead loading apparatus which is positioned near the transport route or railroad track. The material is thereafter loaded into the vehicles, or railroad cars, and the loaded vehicles are moved to an unloading station where the material is unloaded from the vehicles. The material is placed in storage or moved to some other destination for further processing. Of course, the train of vehicles could travel to more than one unloading station positioned alongside the transport route during the course of transporting and delivering the material.

The process of unloading the material from the vehicles at the unloading station generally is accomplished by moving each vehicle in succession into a position generally above a storage bunker or the like and transferring the material into the storage bunker. When the material is to be placed directly into storage, even if temporarily, it has been found desirable to transfer the material from the vehicle into the underground storage bunker while maintaining the particulate material covered during the unloading operation.

It also is desirable that the traveling rate of the vehicle train be relatively fast as the railroad cars move through the unloading station. The efficiency and economy of the unloading operation are enhanced greatly when the train of vehicles can be moved through the unloading station while automatically actuating the mechanisms controlling the unloading of the particulate material.

Figure 1:
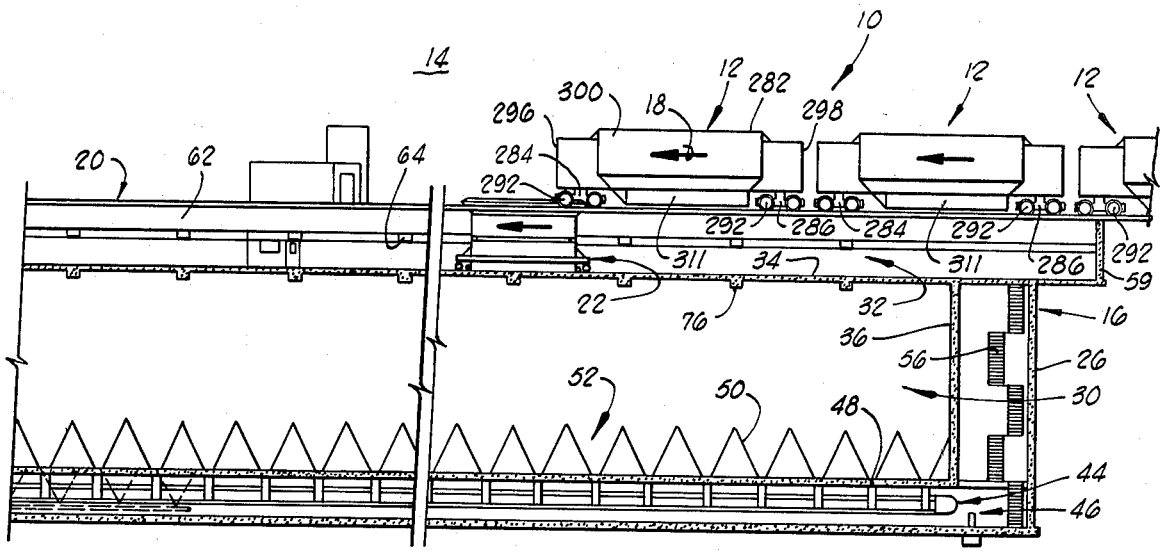
FIG. 1 is a schematic, partial cross-sectional view of the unloading system of the present invention depicting a train of railroad cars entering the unloading station.
Figure 2:
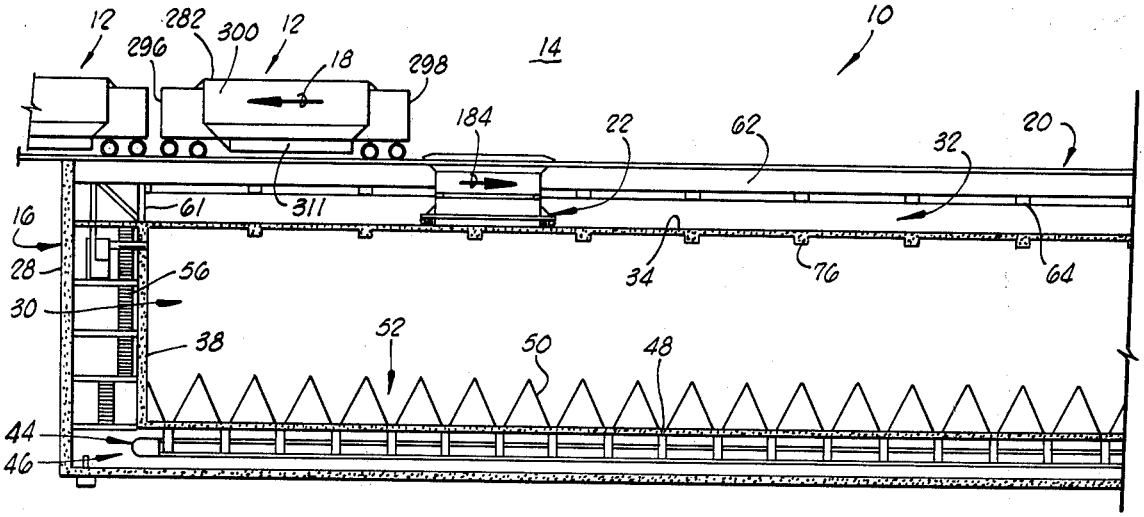
FIG. 2 is a schemmatic, partial cross-sectional view of the unloading system of the present invention depicting the railroad cars departing from the unloading station.

Referring to the drawings in general, and to FIGS. 1 and 2 in particular, shown therein and designated by the general reference numeral 10, is an improved unloading system which is constructed in accordance with the present invention. The unloading system 10 is utilized for automatically transferring a quantity of particulate material from a railroad car 12 at an unloading station 14 into a storage bunker 16 while the railroad car 12 is being moved in a first direction 18 on a transport route in the form of railroad tracks 20. The unloading system 10 is constructed to automatically transfer the material from the railroad car 12 into the storage bunker 16 while maintaining the material in a substantially covered condition during and after the unloading operation.

The apparatus associated with the unloading system 10 generally comprise portions of the railroad car 12 and the storage bunker 16, as well as a traversing car 22 positioned on a tressel track 24 within an upper portion of the storage bunker 16. Furthermore, the unloading system 10 also comprises the moving of the railroad car 12 through the unloading station 14 with the load of material retained in the storage bin of the railroad car 12 being transferred to a lower portion of the storage bunker 16 via the traversing car 22, as will be made more apparent below.

The storage bunker 16 has a first end 26 positioned near the arrival portion of the unloading station 14 and an opposed second end 28 spaced a distance from the first end 26 and positioned near the departing portion of the unloading station 14. Thus, when a train of the cars 12 enters the unloading station 14 at the arrival portion thereof the cars 18 pass over the first end 26 of the storage bunker; and upon the cars 12 leaving the unloading station 14 at the departure portion thereof the cars pass over the second end 28 of the storage bunker 16.

Figure 5:
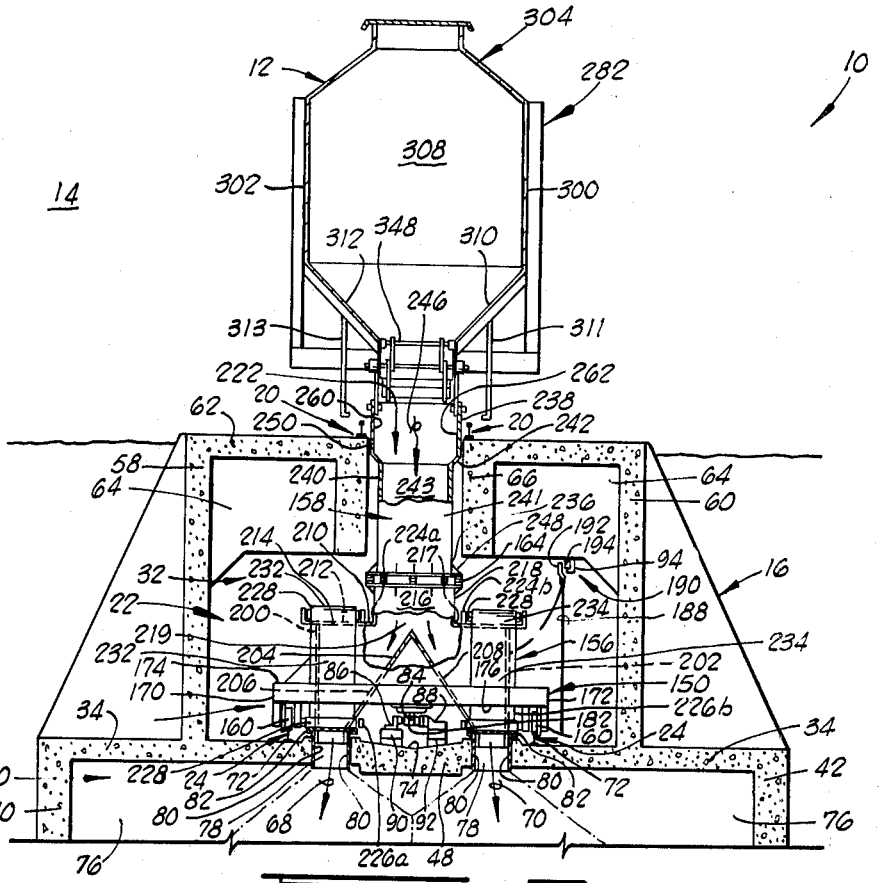
FIG. 5 is a partially broken, end elevational view of the railroad car engaged with the traversing car of FIG. 3 taken along the line 5—5.

Referring now to FIG. 5 in combination with FIGS. 1 and 2, the storage bunker 16 generally comprises a first chamber 30 and an upper chamber 32 positioned above the first chamber 30 and below the track 20 upon which the car 12 is supported. The first chamber 30 and the upper second chamber 32 of the storage bunker 16 are separated by a horizontal partition wall 34 which extends from near the first end 26 of the storage bunker 16 to near the second end 28 of the storage bunker 16. Furthermore, the first chamber 30 is substantially enclosed by a first end wall 36 positioned near the first end 26 of the storage bunker 16, an opposed second end wall 38 positioned near the second end 28 of the storage bunker 16, and opposed first and second side walls 40 and 42, respectively, as shown in FIG. 5, which extend the length of the first chamber 30 between the first and opposed second end walls 26 and 28.

Referring again to FIGS. 1 and 2, a conveyor assembly 44 is positioned in a lower third chamber 46 formed below the first chamber 30. The first chamber 30 and the lower third chamber 46 are separated by a second horizontal partition wall 48. The lower third chamber 46 and the conveyor assembly 44 also extend from near the first end 26 of the storage bunker 16 to near the opposed second end 28 of the storage bunker 16. A plurality of dividers 50 are positioned above the conveyor assembly 44 within a lower portion of the first chamber 30. The dividers 50 substantially form a plurality of hopper bins 52 which facilitate in conveying particulate material to the conveyor assembly 44 in a controlled manner. A discharge slot (not shown) is formed through a medial portion of the second horizontal partition wall 48 between the hopper bins 52 and the conveyor assembly 44. The discharge slot preferably is a series of openings which extend intermittently the length of the conveyor assembly 44. Thus, particulate material can be retained within the hopper bins 52 in a controlled manner while being deposited upon the conveyor assembly 44 by passing through the discharge slot formed through the second horizontal partition wall 48.

Steps or ladders 56 are positioned within the storage bunker 16 near the first and opposed second ends 26 and 28 thereof to provide manual communication between the first chamber 30, the upper second chamber 32 and the lower third chamber 46 of the storage bunker 16.

Referring again to FIG. 5, in combination with FIGS. 1 and 2, the upper second chamber 32 further comprises a first side wall 58, an opposed second side wall 60, a first end wall 59, a second end wall 61, a horizontally disposed ceiling 62, and a plurality of brace members 64 connected between the ceiling 62 and the first and opposed second side walls 58 and 60 and extending substantially between the first end wall 59 and the second end wall 61. A first load opening 66 is formed through the ceiling 62 and extends from near the first end 26 of the storage bunker 16 to near the opposed second end 28 of the storage bunker 16. The load opening 66 substantially provides communication between the upper second chamber 32 and the outside environment surrounding the loading station 14. The rails which form the railroad track 20 are positioned upon the ceiling 62 on either side of the first load opening 66. The portions of the ceiling 62 on either side of the load opening 66 are substantially cantilevered from the first and second side walls 58 and 60 of the upper second chamber 32. In order to enhance the structural integrity of the storage bunker 16 the first and second side walls 58 and 60, the ceiling 62 and the brace members 64 of the upper second chamber 32 comprise an integral structure.

A first transfer opening 68 and a similar second transfer opening 70 are formed longitudinally through corresponding medial portions of the first horizontal partition wall 34 extending from near the first end wall 36 of the first chamber 30 to near the opposed second end wall 38 of the first chamber 30. More particularly, the first transfer opening 68 is positioned nearest the first side wall 58 of the upper second chamber 32 and the second transfer opening 70 is positioned nearest the second side wall 60 of the upper second chamber 32. The first and second transfer openings 68 and 70 are positioned between rails 72 which cooperate to form the tressel track 24. A medial portion of the first horizontal partition wall 34 of the storage bunker 16 located between the first and second transfer openings 68 and 70 is constructed to form a water drain 74.

A plurality of shore braces 76 transversely extend between the first and second side walls 40 and 42 of the first chamber 30; and the shore braces 76 are positioned below the first horizontal partition wall 34. The shore braces 76 are utilized to support the medial portion of the first horizontal partition wall 34 forming the water drain 74, and to enhance the structural integrity of the storage bunker 16.

A deflector plate 78 is connected to the uppermost portion of each shore brace 76 within the first and second transfer openings 68 and 70. The side portions of the first and second transfer openings 68 and 70 are substantially aligned with plates 80, each plate 80 having a flanged upper portion 82 which is disposed within the upper second chamber 32 at a position immediately above the first horizontal partition wall 34. The flanged portions 82 of each plate 80 cooperate to form belt support surfaces.

A gear track 84 is connected to the first horizontal partition 34 generally in the vicinity where the drain 74 is formed. The gear track 84 comprises a first gear rack 86 and a second opposed gear rack 88 which are maintained in a substantially parallel, spaced apart relationship and supported a distance above the drain 74 by support blocks 90 and 92 respectively. The gear track 84 is utilized to facilitate movement of the traversing car 22 within the upper second chamber 32.

Figure 3:
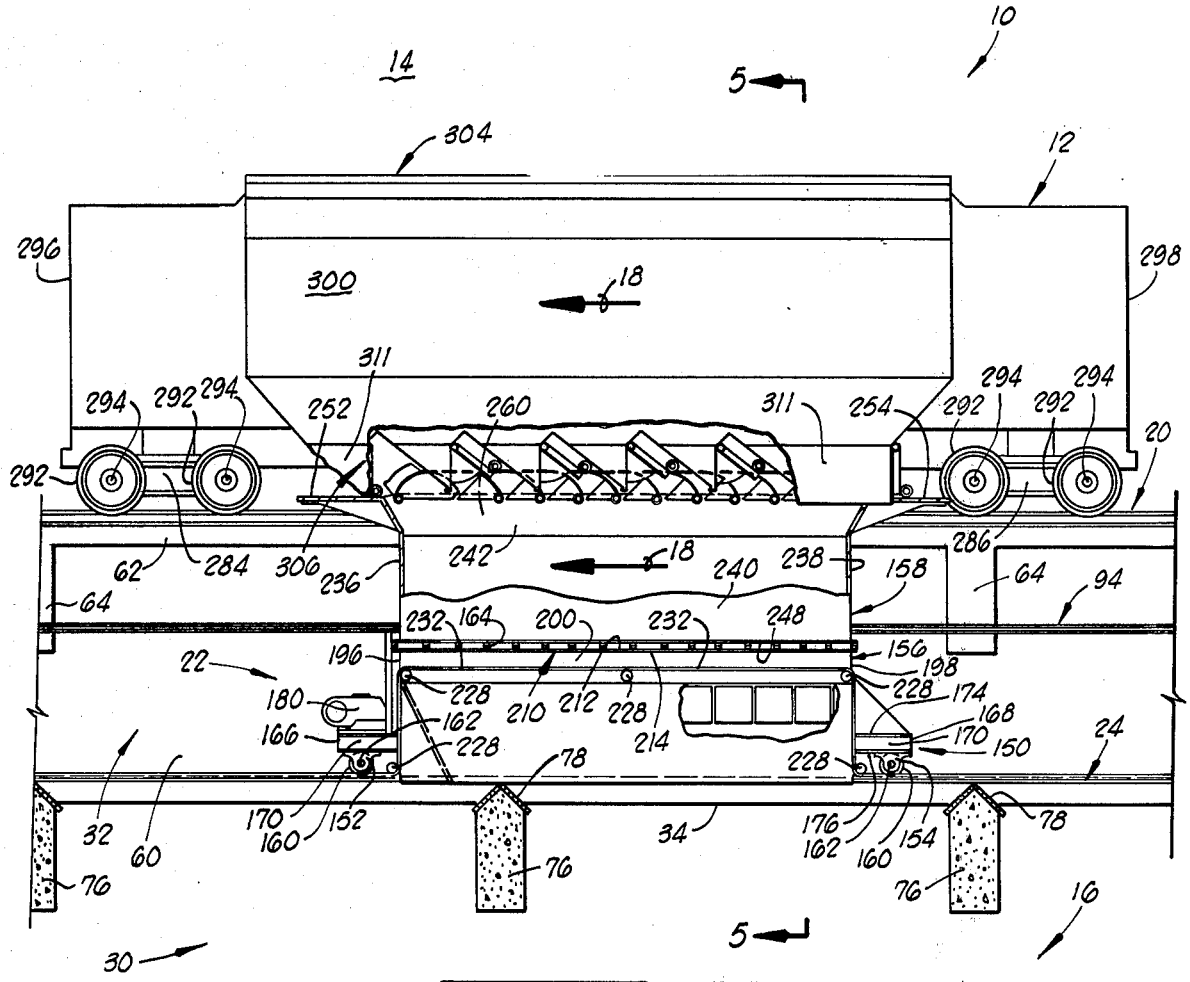
FIG. 3 is an enlarged, partially broken, side elevational view of a railroad car engaged with a traversing car of the unloading station in accordance with the present invention.

Referring now to FIGS. 3 and 5, a wheel guide track 94 is connected to and suspended from corresponding portions of the brace member 64 so that the wheel guide track 94 is generally between the first and opposed second end walls 36 and 38 of the storage bunker 16. The wheel guide track 94 is positioned so as to be near the second side wall 60 of the upper second chamber 32.

Referring now to FIGS. 3 and 5, the traversing car 22 generally comprises: a body 150, a first truck 152, a second truck 154, a deflector housing 156 and a material receiving chute 158. The body 150 is supported upon the first and second trucks 152 and 154 and the first and second trucks 152 and 154 are positioned upon the tressel track 24 for rolling movement through the upper second chamber 32 of the storage bunker 16 via a plurality of wheels 160 which are journally supported via axles 162. The deflector housing 156 is connected to and supported upon the body 150 of the traversing car 22 and the material receiving chute 158 is supported upon the deflector housing 156 via a plurality of load absorbing springs 164.

The body 150 of the traversing car 22 has a first end 166, an opposed second end 168 spaced a distance from the first end 166, a first side 170, an opposed second side 172, an upper side 174 and an opposed lower side 176. The first side 170 of the body 150 faces the first side wall 58 of the upper second chamber 32 of the storage bin 16; and the opposed second side 172 of the body 150 faces the second side wall 60 of the upper second chamber 32 of the storage bin 16.

Figure 6:
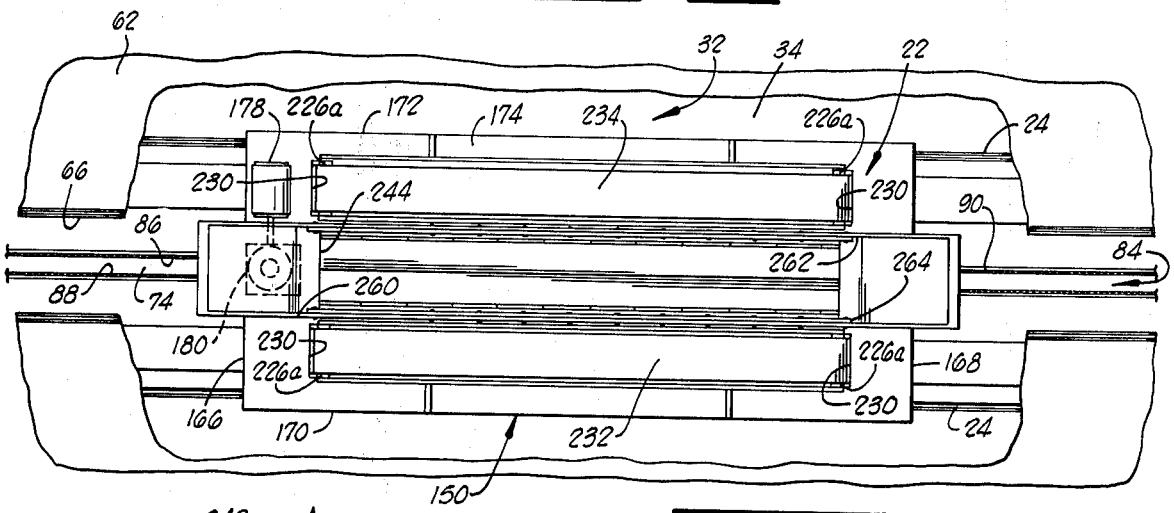
FIG. 6 is a plan view of the traversing car of the unloading system of the present invention.

Referring now to FIG. 6 in combination with FIGS. 3 and 5, the prime mover 178 is supported upon a portion of the upper side 174 of the body 150 of the traversing car 22 near the first end 166 thereof. The prime mover may be, in some applications, a cable and pulley assembly for moving the traversing car through the storage bunker 16. In other applications, the prime mover may be an electric motor as depicted in the drawing and described hereinafter. The power output of the prime mover 178 is coupled to a transmission apparatus 180 also positioned on the upper side 174 near the first end 166 of the body 150 of the traversing car 22. A portion of the transmission apparatus 180 extends through the upper and opposed lower sides 174 and 176 of the body 150 and has a pinion gear 182 connected to a terminal end thereof. The pinion gear 182 is positioned in meshing engagement with the first and second gear racks 86 and 88 of the gear track 84. The prime mover 178 is connected to and controlled via a portion of the control system, as will be made more apparent hereinafter.

The prime mover 178 has an off condition and an on condition. When the prime mover 178 is in the off condition, the traversing car 22 is in a stationary position. When the prime mover 178 is in the on condition, the traversing car 22 is caused to begin moving along the tressel track 24 in a selectable manner. The prime mover 178, the transmission 180 and the control system cooperate to provide a forward and a reverse mode. That is, in the forward mode, the traversing car 22 is caused to move in the first direction 20, and in the reverse mode the traversing car 22 is caused to move in a second direction 184. Any suitable control system can be employed.

The prime mover 178 is in selective communication with the control system (not shown) via a cable 188 housing signal conduits (not shown). The cable 188 is maintained in a position to be substantially clear from the tressel track 24 and the path of the traversing car 22 via a follower assembly 190 movably supported via the wheel guide track 94. The follower assembly 190 generally includes a support member 192 and a guide wheel 194. The guide wheel 194 is journally connected to the support member 192 and the wheel 194 is rollingly positioned within the wheel guide track 94. The control cable 188 is supported above the second horizontal partition wall 48 by the support member 192. As the traversing car 22 moves upon the tressel track 24 the follower assembly 190 is substantially pulled along therewith by the wheel guide track 94 while maintaining the control cable 188 in a cleared position. The control apparatus previously mentioned is utilized to automatically or manually control the direction of movement and the rate of travel of the traversing car 22 by controlling the power output of the prime mover 178 in a conventional manner.

A relatively large rectangularly shaped opening (not shown) is formed through a medial portion of the body 150 of the traversing car 22 and the opening intersects the upper and lower sides 174 and 176 of the body 150. The deflector housing 156, a substantially rectangularly shaped housing is positioned above the body 150 of the traversing car 22 and connected to the upper side 174 of the body 150 generally over the opening formed through the body 150.

The deflector housing 156 is provided with a first end 196, an opposed second end 198 spaced a distance from the first end 196, a first side 200 and an opposed side 202 (shown in phantom in FIG. 5). The first end 196 of the deflector housing 156 is positioned near the first end 166 of the body 150 of the traversing car 22 and the second end 198 of the deflector housing 156 is positioned near the opposed second end 168 of the body 150 of the traversing car 22. The first and second sides 200 and 202 of the deflector housing 156 extend between the first and second ends 196 and 198; and, the first and second sides 200 and 202 of the deflector 154 are disposed near the first and opposed second sides 170 and 172 of the body 150 of the traversing car 22, respectively. Thus, in an assembled position the deflector housing 156 is secured to the body 150 of the traversing car 22 so that the interior portion of the deflector housing 156 is in open communication with the opening formed through the body 150 of the traversing car 22.

A deflector 204 is positioned within the deflector housing 156 and secured between the first and second ends 196 and 198 of the deflector housing 156. The deflector 204 is provided with a first side 206 and a second side 208. The first side 206 extends generally upward and toward the opposed second side 202 of the deflector housing 156, and the second side 208 extends generally upward and toward the first side 200 of the deflector housing 156, the first and second sides 206 and 208 converging at their upwardly extending end portions to form a ridge. The first and second sides 206 and 208 converging at their upwardly extending end portions to form a ridge. The first and second sides 206 and 208 of the deflector 204 are positioned so that the lower end portions of the first and second sides 206 and 208 are disposed within a space formed between the lower side 176 of the body 150 of the traversing car 22 and the first horizontal partition wall 34 of the storage bunker 16, near the first and second transfer openings 68 and 70, respectively; and the ridge formed by the upper portions of the first and second sides 206 and 208 is positioned on a level near the uppermost portion of the deflector housing 156.

A housing cover 210 having an upper first side 212 and a lower second side 214 is connected to and supported upon the deflector housing 156. The lower second side 214 is a steel plate and is an integral part of the traversing car 18. The housing cover 210 extends longitudinally between the upper portions of the first and second ends 196 and 198 of the deflector housing 156 and transversley between the upper portion of the first and second sides 200 and 202 of the deflector housing 156. Thus, the housing cover 210 substantially covers the deflector housing 156.

An opening is formed through a medial portion of the housing cover 210, the opening extending from near the first end 196 to near the second end 198 of the deflector housing 156. The opening, when viewed from above, has a generally rectangular shape.

A neck member 216 having a lower end portion 217 and a peripheral flange 218 formed at the upper portion of the neck member 216 is connected at the lower end portion 217 to the upper side 212 of the housing cover 210. The neck member 216 is secured to the housing cover 210 so that the neck member is positioned over the opening formed through the housing cover 210. The neck member 216 which is further provided with a passageway 219 extending between the lower end portion 217 and the flange 218 formed at the upper end portion of the neck 216. Thus when the lower end portion 217 of the neck member 216 is secured to the upper side 212 of the housing cover 210, the passageway 219 of the neck member 216 is in communication with the opening formed through the housing cover 210.

A closure means (not shown) can be connected to the lower end portion 217 of the neck. Such closure means would have a closed first position and an open second position. The closure means would normally be positioned in the closed first position and are caused to be moved to the open second position when particulate material flows through a channel 222 extending through the traversing car 22. The closure means would return to the closed first position when the flow of material ceases. Thus, the closure means would prevent rain, dust, and the like from entering the first chamber 30 of the storage bunker 16 via the traversing car 22.

A plurality of upper rollers support members, such as upper roller support members **224*a* and 224*b*, as depicted in FIG. 5, are connected to the upper side 212 of the housing cover 210 so that the upper roller support members 224*a* and 224*b* are maintained in a parallel, spaced-apart relationship and are disposed on each side of the neck member 216. In addition, a plurality of lower roller support members, such as lower roller support members 226*a* and 226*b* are connected to the lower side 176 of the body 150 of the traversing car 22. The upper and lower roller support members 224*a*, 224*b*, and 226*a* and 226*b* are employed to journally support a plurality of belt rollers, generally designated by the numeral 228, in a manner to be made more apparent hereinafter. Each upper roller support member 224*a* and 224*b* is generally plate-like in structure and extends perpendicularly upward a distance from the upper side 212 of the housing cover 210 from near the first end 196 of the deflector housing 156 to near the second end 198 of the deflector housing 156**.

Referring now to FIG. 3, in combination with FIG. 5, a plurality of belt rollers 228 are journally supported by the upper roller support members **532*a* and 532*b*, a distance above the upper side 212 of the housing cover 210. The positioning of the belt rollers 228 is depicted in FIG. 3. A lower roller support (226*a* or 226*b*) is positioned near one corner of the body 150 of the traversing car 22. One of the belt rollers 228 is journally supported by each of the lower roller supports 226*a* or 226*b*. Each belt roller 228 which is supported by one of the lower roller supports, either lower roller supports 226*a* or 226*b*, is aligned in an off-set manner with one of the belt rollers 228 supported by the corresponding upper roller support member 224*a* or 224*b*. As shown in FIG. 3, one of the belt rollers 228, viewed as an upper belt roller, is positioned generally vertically above a second belt roller 228, depicted as a lower belt roller, with the second or lower belt roller 228 being slightly off-set in a direction away from the upper or first belt roller 228 and toward the first end 166 of the body 150 of the traversing car 22**.

As shown more clearly in FIG. 6, a belt slot 230 is formed through the upper side 174 and the opposed lower side 176 of the body 150 of the traversing car 22, the belt slot 230 being generally positioned between each upper and lower belt roller 226 and positioned in a manner corresponding to the relationship of the upper and lower belt rollers 226. Desirably, there are four of the belt slots 230 formed through the body 150 of the traversing car 22.

Referring to FIGS. 3, 5 and 6, a first seal belt 232 and a similar second seal belt 234 are position, respectively, over the first and second transfer openings 68 and 70. The first and second seal belts 232 and 234 are connected at opposite ends (not shown) thereof to supportive portions of the storage bunker 16 in a conventional manner to maintain a predetermined tension on the first and second seal belts 232 and 234. More particularly, the first and second seal belts 232 and 234 rest upon the flanged upper portion 82 of the plates 80 which line the first and second transfer openings 68 and 70, respectively, as shown in FIG. 5.

Referring more specifically to FIG. 3, a medial portion of the first seal belt 232 is substantially threaded between the upper and lower belt rollers 228 and two of the belt slots 230 positioned near the first side 200 of the deflector housing 156. The second seal belt 234 is similarly threaded between the upper and lower belt rollers 228 and two of the belt slots 230 positioned near the opposed second side 202 of the deflector housing 156. Thus, the traversing car 22 can move upon the tressel track 24 with the first and second transfer openings 68 and 70 being substantially continuously covered via the first and second seal belts 232 and 234 or the housing cover 210.

Referring again to FIGS. 3 and 5, the material receiving chute 158 is supported upon the flange 218 of the neck member 216 via the load absorbing springs 164. The chute 158 has a lower first end 236, an upper opposed second end 238 spaced a distance from the first end 236, a first side 240 a second side 241, a third side 242, which is opposed to the first side 240, and a fourth side 243 which is opposed to the second side 241. The first, second, third and fourth sides 240, 241, 242 and 243 are interconnected so as to form a chute having a boxlike configuration which is provided with a generally rectangularly shaped opening 244 extending therethrough which cooperates with the passageway 219 of the neck member 216 and the opening of the housing cover 210 to form a flow channel 246.

The outer periphery of the lower extending portion of the chute 158 has a flange portion 248 formed thereabout. In an assembled position of the housing cover 210, the neck member 216, and the chute 158, the flanged portion 248 of the chute 158 is connected to the flange 218 of the neck member 216 via the load absorbing springs 164. Thus, the material receiving chute 158 is normally maintained at a predetermined position in relation to the level of the tracks 20.

An upper portion 250 of the chute 158 diverges generally upwardly and outwardly from a medial portion of the chute 158. In addition, the upper portion 250 of the chute 158 extends a distance upwardly and out of the upper second chamber 32 of the storage bunker 16 through the first load opening 66 of the storage bunker 16 formed between the track 20.

Figure 4:
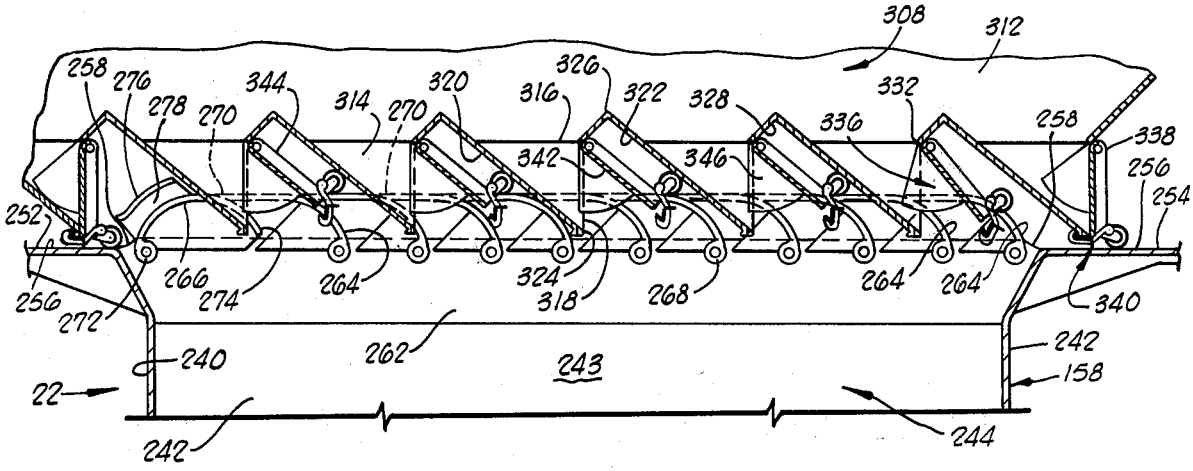
FIG. 4 is an enlarged, partially broken, side elevational view of a portion of the railroad car and traversing car of FIG. 3.

Referring now to FIGS. 4 and 5, a first guide track 252 is secured to the upper end 238 of the chute 158, the first guide track 252 being positioned on the first side 240 of the chute 158. Similarly, a second guide track is secured to the upper end 238 of the chute 158, the second guide track being disposed in a spaced-apart relationship with the first guide track 252 and secured to the opposed side 242 of the chute 158. The first guide track 252 comprises a lower, substantially horizontally disposed side 256 which extends outwardly away from the upper end of the first side 240 of the chute 158, and an upwardly sloping side 258 which extends upwardly and inwardly from the upper end of the first side 240 of the chute 158 towards the rectangularly shaped opening 244 of the chute 158. The second guide track 254 comprises a lower, substantially horizontally disposed side 257 which extends outwardly away from the upper end of the opposed side 242 of the chute 158, and an upwardly sloping side 259 which extends upwardly and inwardly from the upper end of the opposed second side 242 of the chute 158 towards the rectangularly shaped opening 244 of the chute 158. The first and second guide tracks 252 and 254, and the configuration of same, can be more clearly seen in FIG. 4.

The upper portion 250 of the chute 158 further comprises a first side plate 260 and an opposed second side plate 262 positioned so as to be on opposite side portions of the opening 244 of the chute 158. The first and second side plates 260 and 262 are secured to the upper portion 250 of the chute 158 so that they substantially diverge upwardly and outwardly and extend generally between the sides 241 and 243 of the chute 158.

Referring to FIG. 4, a plurality of guide arms 264 are journally connected to corresponding inner portions of the first and opposed second side plates 260 and 262 disposed within the opening 244 of the chute 158. The guide arms 264 are positioned in a spaced-apart relationship from near the first side 240 of the chute 158 to near the opposed second side 247 of the chute 158. In addition, two second guide arms 266 are journally connected to the first and second side plates 260 and 262 and extend into the opening 244 of the chute 158.

Each of the guide arms 264 is generally curved and has an enlarged first end 268 and a second end 270. The first end 268 of each of the guide arms 264 is connected to a portion of the first or second side plates 260 or 262 so that the second end 270 of the respective guide arm 264 extends a distance from the first end 268 and is positioned in a space above the opening 244 of the chute 158. Each of the guide arms 264 curve generally upwardly from the first end 268 thereof and into the environment surrounding the unloading station 14, with a portion of each of the guide arms 264 near the second end 270 thereof being generally straight and horizontally disposed in a first position of the guide arm 264 as shown in FIG. 4. Furthermore, in the first position of each guide arm 264, the straight portion thereof overlaps the curved portion of an adjacent guide arm 264 (or a second guide arm 266). Thus, in the first position of the guide arm 264 the straight guide portions of the guide arms 264 substantially form a horizontal guide surface positioned at a predetermined level above the level of the track 20.

Each of the guide arms 266 has an enlarged first end 272 connected to an inner portion of the first or second side plates 260 or 262, and a second end 274 positioned and spaced journally above the opening 244 of the chute 158. The guide arms 266 are generally similar in construction to the guide arms 264. However, each of the guide arms 266 curves generally upwardly from the first end 272 thereof to approximately the level of the straight portions of the guide arms 264, with the second end 274 of each of the guide arms 266 curving downwardly towards the opening 244 in a direction toward the opening 244 of the chute 158. In addition, the second end 270 of each of the guide arms 264 is biased and the guide arms 264 are adjacently disposed, one with another, when the respective guide arms 264 and 266 are in a first position. The guide arms 266 are also selectively positionable and are biased to the first position in a manner similar to that of the guide arms 264. The cooperation between the guide arms 264 and the second guide arms 266 can be seen in FIG. 4.

Each guide arm 266 has a guide member 276 connected to an upper portion thereof. Each guide member 276 generally follows the curvature of its respective guide arm 276. A guide slot 278 is substantially formed via each guide member 276, each guide slot 278 facing generally inwardly.

Referring again generally to FIGS. 1 through 10, the railroad car 12 generally comprises: a body 282, a first truck 284 and a second truck 286. The body 282 is semi-rigidly supported on the first and second trucks 284 and 286 via first and second load absorbers 288 and 290, respectively. The first and second trucks 284 and 286 are positioned upon the track 20 for rolling movement via a plurality of wheels 292 which are journally supported via axles 294. The body 282 is rollingly supported on the track 20 via the trucks 284 and 286 and the wheels 292.

The car 12 has a leading first end 296 and a trailing second end 298. In other words, when the car 12 is moving in the first direction 18 the leading first end 296 moves into the arrival end of the unloading station 14 in advance of the trailing second end 298. Further, the car 12 has a first side 300 and an opposite side 302. The first and second end walls (not shown) are formed at the first leading end 276 and the trailing second end 288, respectively, of the car 12. The car 12 is further provided with a ceiling 304 and a floor 306. Thus, the first and second ends, the first side 300, the second side 302, the ceiling 304 and the floor 306 cooperate to form a storage bin 308 in the car 12 for receiving and holding the particulate material.

Shown more clearly in FIG. 5, the floor 306 comprises a first side floor member 310 and a second side floor member 312. The first and second side floor members 310 and 312 extend between the first end wall and the second end wall (not shown) of the car 12. The first side floor member 310 is connected to a lower portion of the first side 300 of the car 12 and the second side floor member 312 is connected to a lower portion of the second side 302 of the car 12 so that the first and second side floor members 310 and 312 slope downwardly from the opposite portions of the first and second sides 300 and 302 in a near-converging manner to form a floor opening (not shown) therein which is in communication with the storage bin 308 of the car 12. Further, a pair of skirt members, 311, 313 are secured to the first and second side floor members 310, 312, respectively, such that the skirt members 311, 313 depend in a downwardly direction towards track 20 as depicted in FIG. 5. The skirt members 311, 313 assist in the prevention of foreign matter entering the storage bin 16 during the transfer of particulate materials into the storage bin 16.

Referring now to FIGS. 4, 8, 9 and 10, a portion of the unloading system 10 is formed generally between the first and second side floor members 310 and 312. More particularly, a plurality of triangularly shaped side plates 314 are connected to the lowermost portions of the first and second side floor members 310 and 312 in a spaced-apart relationship from near the first end wall (not shown) of the storage bin 308 to near the second end wall (not shown) of the storage bin 308. Furthermore, the side plates 314 extend a distance vertically downward from the first and second side floor members 310 and 312 to a predetermined level above the track 20.

Each side plate 314 has a horizontally disposed first side 316 connected to a portion of the first or second side floor members 310 and 312, a vertically disposed second side 318 facing toward the trailing second end 298 of the car 12, and a third side 320 disposed at an angle of approximately 45° in relation to the horizontal. The side plates 314, when assembled with the first and second side floor members 310 and 312, are employed substantially in pairs. That is, one side plate 314 of each pair is connected to a portion of the first side floor member 310 and the other side plate 314 of the pair is connected to the corresponding portion of the second side floor member 312 in such a manner that a space is formed between the pair of side plates 314.

A first floor plate 322 is connected generally between each pair of the side plates 314. Each floor plate 322 has a lower first end 324, an upper second end 326, opposite first and second sides (not shown). In an assembled position of one of the first floor plates 322 and a pair of the side plates 312, the first side of each first floor plate 322 is connected to the third side 320 of one of the side plates 314 which is connected to the first side floor member 310, and the second side of each first floor plate 322 is connected to the third side 320 of one of the side plates 314 connected to the second side floor member 312. The lower first end 324 of each first floor plate 322 is positioned generally at the lowest level of a pair of the side plates 314 (that is, between the intersection of the second and third sides 318 and 320 of the respective pair of side plates 314). The upper second end 326 of each first floor plate 322 extends generally upwardly a distance at approximately 45° from the lower first end 324 thereof and is positioned within a lower portion of the storage bin 308. The portions of the first and second sides of each first floor plate 322, near the upper second end 326, diverge outwardly in a direction toward the upper second end 326, the upper portions of the first and second sides thereby being connected to and conforming to the slopped nature of the first and second floor members 310 and 312.

A second floor plate 328 is connected to each first floor plate 322 within the lower portion of the storage bin 308. Each second floor plate 328 has an upper first side 330, a lower second side 332, and opposite first and second ends (not shown). The upper first side 330 of each second floor plate 328 is connected to the upper second end 326 of one of the first floor plates 322 so that the second floor plate 328 extends a distance downwardly therefrom at approximately a 45° angle. A ridge 334 is formed by the connection of each of the first and second floor plates 322 and 328. The lower second side 332 of each second floor plate 328 has an end portion generally positioned at the intersection of the first and second sides 316 and 318 of each respective side plate 314. The portions of each second floor plate 328 near the first and second ends thereof are also connected to corresponding portions of the first and second side floor members 310 and 312 in a manner similar to that of the first and second side portions of the first floor plates 322.

The side plates 314, the first floor plates 322 and the second floor plates 328 cooperate to substantially enclose a space formed between the lower portions of the first and second side floor members 310 and 312. However, a discharge opening 336 is formed generally between each pair of the side plates 314, the discharge openings 336 facing towards the trailing second end 298 of the car 12.

Each discharge opening 336 is selectively covered or uncovered via a closure gate 338. The closure gate 338 is pivotally connected to a portion of one of the second floor plates 328 at a position adjacent the respective discharge opening 336. That is, the discharge opening 336 is covered by one of the closure gates 338 when the gate 338 is in a closed first position; and, the discharge opening 336 is uncovered when the gate 338 is in an opened second position. Each closure gate 338 is maintained in the closed first position via a latch assembly 340 which is pivotally connected to a lower portion of the respective closure gate 338 when the latch assembly 340 is in a locked position. When the latch assembly 340 is in an unlocked position, the respective closure gate 338 can be moved from the closed first position to the opened second position thereby exposing one of the discharge openings 336 to the surrounding environment. The latch assemblies 340 and closure gates 338 are progressively moved from the locked and closed first position to the unlocked and opened second position, respectively, via the traversing car 22.

Each closure gate 338 generally comprises: a cover plate 342, backing ribs 344, and two side plates 346. Each cover plate 342 is generally rectangularly shaped and is sized to cover one of the discharge openings 336. As can be seen in FIGS. 5 and 8 through 10, a first supportive shaft 348 is horizontally disposed and journally connected between corresponding portions of the first and second side floor members 310 and 312, generally near the lower second side 332 of each second floor plate 328. In an assembled position of the closure gate 338 and the first support shaft 348, the associated backing ribs 344 are connected to the respective first support shaft 348.

Figure 9:
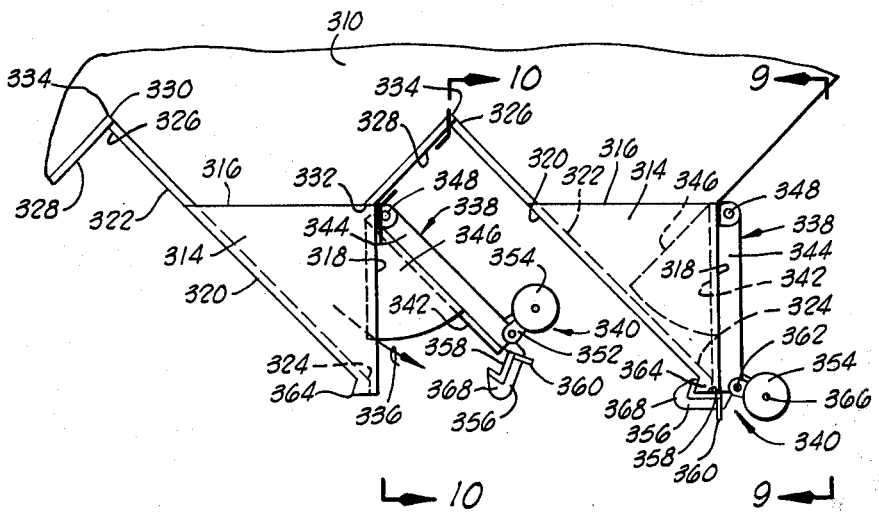
FIG. 9 is a fragmentary, end view of the railroad car and unlatching assembly of the present invention of FIG. 8 taken along line 9—9.
Figure 8:
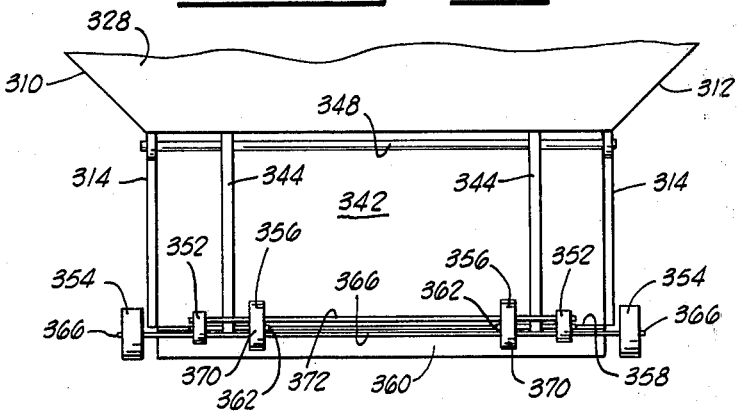
FIG. 8 is an enlarged, fragmentary, end view of the lower portion of the railroad car having one of the unlatching assemblies of the present invention attached thereto.
Figure 10:
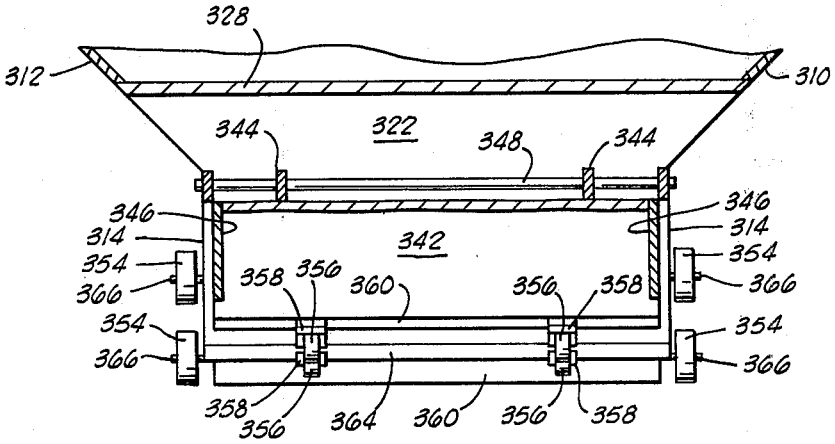
FIG. 10 is a fragmentary, sectional view of the railroad car having the unlatching assembly of the present invention attached thereto to FIG. 8 taken along the line 10—10.

Referring now to FIGS. 8 and 9, each latch assembly 340 comprises: two lever arms 352, two guide wheels 354, two bar clamps 356, two seal plates 358, a seal flap 360 and two second support shafts 362. In addition, a lip 364 is formed on each first floor plate 322, near the lower first end 324 of the respective first floor plate 322. A portion of each latching assembly 340 engages one of the lips 364 in a locked position of the latching assembly 340.

Each of the second support shafts 362 interconnect a lever arm 352, a backing rib 344, and a bar clamp 356. The second support shaft 362 is connected to the lever arm 352 so that the lever arm 352 is positioned generally outwardly from the backing rib 344. One of the guide wheels 354 is journally connected to each lever arm 352 via a third support shaft 366, in such a manner that each guide wheel 354 is positioned outwardly from the associated lever arm 352. Desirably, the third support shaft 366 interconnects the two guide wheels 354 associated with each latch assembly 340. Thus, each assembly of two of the lever arms 352, two of the guide wheels 354, and one of the third support shafts 366 can pivot as a single unit.

Figure 7:
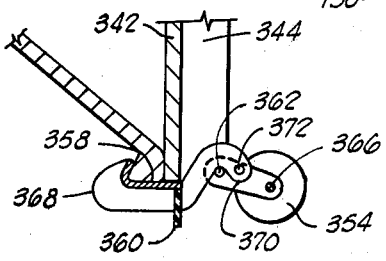
FIG. 7 is an enlarged, fragmentary, side elevational view of an unlatching assembly of the unloading system of the present invention.

Referring now to FIGS. 7 and 8, each bar clamp 356 has a hooked first end 368 and a curved second end 370. Each bar clamp 356 is positioned near an inwardly facing portion of one of the backing ribs 344 and is connected to an adjacent lever arm 352 via a shaft 372. A substantially concave portion of each bar clamp 356 rests upon an end portion of one of the second support shafts 362 when the respective latch assembly 340 is in a locked position. Thus, each bar clamp 356 is engaged with one of the lips 364 when the latch assembly 340 is in a locked position.

Two of the bar clamps 356, two of the seal plates 358 and one of the seal flaps 360 generally form the clamping assembly. In the closed position of one of the latching assemblies 340, similar concave portions of the seal plates 358 are seated against the convexed portion of the lip 364 on an adjacent first floor plate 322.

Operation of the Unloading System

As the car 12 enters the unloading station 14 the car 12 is carrying a load of particulate material in the storage bin 308. The car 12 is traveling in the first direction 18. The traversing car 22 is stationarily positioned on the tressel track 24 near the first end 26 of the storage bunker 16, and the prime mover 178 is in an off condition. The first chamber 30 and the hopper bins 52 of the storage bunker 16 are substantially empty and the conveyor system 44 is in an off condition.

Initially, when the car 12 enters the arrival end of the unloading station 14, and passes over the first end 26 of the storage bunker 16, the control system senses the presence and rate of travel of the car 12 and the prime mover 178 is placed in a forward, on condition. Thus, the traversing car 22 begins accellerating in the first direction 18. The traversing car 22 is caused to be accellerated in such a manner that the leading axle 294 of the car 12 engages the guide arms 264 of the traversing car 22 near the first end 26 of the storage bunker 16. In other words, when the car 12 engages the traversing car 22, the traversing car 22 is moving at a rate of travel slightly less than the rate of travel of the car 12. Thus, the car 12 progressively travels over the traversing car 22 while moving through the unloading station 14.

Each axle 294, in turn, engages the guide arm 264 while moving over the traversing car 22. Since the guide arms 264 are downwardly pivotable, each guide arm 264 is moved from the first position to the second position via engagement with one of the axles 294. Of course, when an axle 294 disengages from the guide arm 264, the respective guide arm 264 automatically moves from the second position to the first position via the biasing means connected thereto. In essence, the guide arms 264 are constructed to pivot downwardly to clear the way for the axles 294 of the car 12.

After the axles 294 of the first truck 284 of the car 12 have passed over a pair of guide arms 264, the guide wheels 354 of the leading latch assembly 340 (the latch assembly 340 being positioned nearest the leading end 296 of the car 12) rollingly engages the lower side 256 of the first guide track 252 so that any slack in the latch assembly 340 is removed. Each guide wheel 354 then rollingly engages the upper slopping side 258 of the first guide track 252 and the curved portions of the first pair of guide arms 264. As the guide wheels 354 of the leading latch assembly 340 roll upwardly on the curved portions of the first pair of guide arms 264, the associated lever arms 352 are caused to be pivoted upwardly about one of the second support shafts 362 so that an adjacent shaft 372 lifts upwardly against the concave portions of the associated bar clamps 356. The bar clamps 356, in turn, pivot downwardly about the second support shaft 362 so that the hooked portion of the bar clamps 356 and the seal plates 358 connected to the bar clamps 356 are disengaged from an adjacent lip 364.

As the guide wheels 354 progressively follow the path formed via the guide arms 264, each closure gate 388 is caused to be pivoted upwardly about one of the first support shafts 348. The closure gate 388 is positioned in an opened position when the guide wheels 354 are positioned on the horizontal portion of the guide path formed via the guide arms 264. As each closure gate 338 is opened, the particulate matter contained in the storage bin 308 of the car 12 flows through the discharge opening 336 and into the opening 244 formed through the traversing car 22 and into the material receiving chute 158. Each closure gate 338 is progressively opened in a similar manner as the car 12 moves through the unloading station 14 and over the traversing car 22.

As each guide wheel 354 nears the end of the path formed via the guide arms 264, the guide wheels 354 engage a curved portion of one of the guide arms 266 and is automatically positioned within the guideslot 278 of one of the guide members 276. The guide wheel 354 then follows the downwardly curving portion of the guide arm 266. Thus, each closure gate 338 is moved from the opened second position to the closed first position via the respective guide wheels 354 generally following the path formed via the guide arms 266.

Each pair of guide wheels 354 then progressively engages the upper sloping side 259 and the lower side 257 of the second guide track 254 so that the respective lever arms 352 pivot downwardly and the adjacent bar clamps 356 pivot upwardly into locking engagement with an adjacent lip 364. Each latch assembly 340 is thereby positioned in the locked first position with the associated closure gate 338 being positioned in the locked closed position.

The particulate matter falling from the discharge openings 336 and into the channel 222 formed through the traversing car 22 thereafter flows through the material receiving chute 156 and into and through the neck member 216. When the particulate material falls against the ridge portion of the deflector 204, some of the particulate material flows along the first side 206 of the deflector 204 and towards the first transfer opening 268, and some of the particulate material flows along the second side 208 of the deflector 204 and toward the second transfer opening 70.

The closure flaps 220 are normally positioned in a closed sealed position against the first side 206 or the second side 208 of the deflector 204. However, when the particulate material flows through the channel 222 the closure flaps 220 are forcibly moved from the closed first position to an opened second position so that the particulate material continues flowing through the channel 222. The particulate material then flows through the first or second transfer opening 68 or 70 and into the first chamber 30 of the storage bunker 16. As the particulate material falls into the first chamber 30, it is received by the hopper bins 52. Additionally, any of particulate material falling upon the deflector plates 78 immediately slides off of the deflector plates 78 and into the first chamber 30.

As long as the conveyor assembly 44 remains in an off condition, the particulate material continues to pile up within the first chamber 30 (or, if the conveyor assembly 44 is in an on condition, the particulate material will continue to pile up if the amount of particulate material flowing into the first chamber 30 exceeds the amount of particulate material being removed from the first chamber 30 via the conveyor assembly 44). If the particulate material should pile up within the first chamber 30 to a level near the first horizontal partition wall 34 of the storage bunker 16 (or to any predetermined level within the first chamber 30), the centers 186 depending from the body 150 from the traversing car 22 will provide such information to the control system. The control system will thereafter control the rate of travel of the traversing car 22 to more evenly distribute the particulate material in the first chamber 30, or to cease the flow of the particulate material into the first chamber 30 by decreasing the rate of travel of the traversing car 22 so that the traversing car 22 will disengage from the car 12.

After the car 12 has passed over the storage bunker 16 and the traversing car 22, or when a desired amount of the particulate material has been transferred into the first chamber 30, the control system responds accordingly and causes the traversing car 22 to move in a second direction 184 opposite the first direction 18, and into the stationary position near the first end 26 of the storage bunker 16.

The conveyor assembly 34 can then be placed in an operable position (if not already in an operable position) so that the particulate material is transferred from the first chamber 30 to the processing station 54 via the conveyor assembly 44. Any particulate material positioned in the hopper bins 52 will thus automatically fall through the openings formed through the second horizontal partition wall 48 and be deposited on the conveyor assembly 44.

It is clear that the present invention is well adapted to carry out the objects and attain the ends and advantages mentioned as well as those inherent therein. While a presently preferred embodiment of the invention has been described for the purposes of this disclosure, numerous changes may be made which will readily suggest themselves to those skilled in the art and which are encompassed with the spirit of the invention disclosed and as defined in the appended claims.

What is claimed is:

1. An unloading system for transferring particulate material from a moving vehicle having a storage bin to an underground storage assembly while substantially protecting the particulate material from the surrounding outside environment, said apparatus comprising:

an underground storage assembly having at least a first chamber and an upper second chamber, the first and upper second chambers being separated by a first partition wall, the first partition wall having at least one opening therein providing communication between the first and upper second chambers;

sealing means operatively disposed in the opening of the partition wall, the sealing means having a closed first position to substantially close the opening in the partition wall and an open second position to allow communication between the upper second chamber and the first chamber;

traversing means having a flow channel therein, the traversing means being movably disposed within the upper second chamber, the traversing means being operatively engagable with the vehicle to establish communication between the vehicle storage bin and the flow channel, and the traversing means being operatively engagable with portions of the sealing means to position the sealing means in the open second position to establish communication between the first chamber and the flow channel, and the traversing means being operatively engagable with portions of the sealing means to position the sealing means in the closed first position to interrupt communication between the flow channel and the first chamber, the traversing means being engagable with the vehicle and being movable with the vehicle and the traversing means engaging portions of the sealing means to position the engaged portions of the sealing means in the second open position to establish communication between the vehicle storage bin and the first chamber via the flow channel while the traversing means is moving with the vehicle, the traversing means engaging portions of the sealing means to position the engaged portions of the sealing means in the closed first position after the traversing means has moved over such portions of the sealing means.

2. The unloading system of claim 1 wherein the upper second chamber is provided with an opening therein, the opening extending substantially the length of the upper second chamber and being of a width to allow the vehicle to move over the underground storage assembly and maintain the opening beneath the storage bin of the vehicle.

3. The unloading system of claim 2 wherein the storage assembly further comprises:

a lower third chamber, the lower third chamber being positioned below the first chamber;

a second partition wall separating the first chamber and the lower third chamber, the second partition wall having an opening positioned in the medial portion thereof and extending substantially the length of the second partition wall; and conveyor means positioned within the lower third chamber for moving the particulate material transferred to the lower third chamber through the lower third chamber to a processing station.

4. The unloading system of claim 3 which further includes a plurality of dividers positioned above the conveyor means within a lower portion of the first chamber, the dividers substantially forming a plurality of hopper bins which facilitate in conveying particulate material to the conveyor means in a controlled manner.

5. The unloading system of claim 4 wherein the first partition wall is provided with two openings therein extending substantially the length of the first partition wall, the two openings being formed in a medial portion of the first partition wall, the two openings being positioned in a substantially parallel relationship one with another.

6. The unloading system of claim 5 wherein the first chamber is provided with a first end wall, an opposed second end wall, a first side wall and an opposed second side wall and the upper second chamber is provided with a first end wall, a second end wall, a first side wall, a second wall, and a ceiling.

7. The unloading system of claim 6 which further includes a plurality of shore braces transversely extending between the first and opposed second side wall of the first chamber, the shore braces being positioned below the first partition wall to form a support for a medial portion of the first partition wall and form a water drain in the first partition wall.

8. The unloading system of claim 7 wherein the storage assembly further includes a plurality of deflector plates, one of the deflector plates being connected to an uppermost portion of each shore brace so that a portion of each deflector plate is positioned within the first and second openings of the first partition wall and the deflector plate is substantially aligned with the sides of the first and second openings, each deflector plate further having a flanged upper portion which is disposed within the upper second chamber at a position above the first horizontal partition wall, the flange portions of each plate cooperating to form a belt support surface.

9. The unloading system of claim 8 wherein the storage assembly further comprises a gear track operably connected to the first horizontal partition wall in close proximity to the water drain formed in the first partition wall, the gear track comprising:

a first gear rack;

a second opposed gear rack, the first and second opposed gear racks being maintained in a substantially parallel, spaced apart relationship and supported on the first horizontal partition wall so as to be a distance above the water drain, the gear track being utilized to facilitate movement of the transversing means through the upper second chamber.

10. The unloading system of claim 9 wherein the first and second opposed gear racks of the gear track are supported upon the first horizontal partition wall by a plurality of support blocks.

11. The unloading system of claim 10 wherein the sealing means is operably disposed in the first and second openings in the first horizontal partition wall and the sealing means comprises:

a first seal belt;

a second seal belt, the first seal belt being operably positioned over the first opening in the first horizontal partition wall so that the first seal belt rests upon the flanged upper portions of the plates lining the first opening, and the second seal belt is operably positioned over the second opening in the first horizontal partition wall, the second seal belt resting upon the flanged upper portions of the plates lining the second opening of the first horizontal partition wall.

12. The unloading system of claim 11 which further includes a track assembly operably positioned on the first horizontal partition wall so as to be disposed within the second upper chamber, the track assembly further having the first and second openings in the first horizontal partition wall disposed therebetween.

13. The unloading system of claim 12 wherein the traversing means comprises:

a traversing car having a body, a first truck, a second truck, a deflector housing, and a material receiving chute, the body being supported upon the first and second trucks and the first and second trucks being movably positioned upon the track assembly for movement through the upper second chamber of the storage assembly, the deflector housing being connected to and supported upon the body of the traversing car and the material receiving chute being supported upon the deflector housing by a plurality of load absorbing springs.

14. The unloading system of claim 13 wherein the body of the traversing car is supported upon a plurality of wheels by a plurality of axles and wherein the wheels are rotatably positioned upon the track assembly.

15. The unloading assembly of claim 14 wherein the body of the traversing car is provided with a first end, an opposed second end spaced a distance from the first end, a first side, an opposed second side, an upper side, and a lower side.

16. The unloading system of claim 15 wherein the traversing car is further provided with a mover assembly supportably positioned upon the upper side of the body near the first end thereof for moving the traversing car through the upper chamber of the underground storage assembly.

17. The unloading system of claim 16 wherein the body of the traversing car is provided with a rectangularly shaped opening extending therethrough which intersects the upper and lower sides of the body, the deflector housing is a substantially rectangularly shaped housing and is positioned above the body of the traversing car and connected to the upper side of the body generally over the opening formed therethrough, the deflector housing being provided with a first end, an opposed second end spaced a distance from the first end, a first side and an opposed second side, the first end of the deflector housing being positioned near the first end of the body of the traversing car and the second end of the deflector housing being positioned near the opposed second end of the body of the traversing car, the first and second sides of the deflector housing extending between the first and second ends of the deflector housing and the first and second sides of the deflector being disposed near the first and opposed second sides of the body of the traversing car, and the deflector housing being secured to the body of the traversing car so as to provide open communication between the opening extending through the deflector housing and the opening extending through the body of the traversing car.

18. The unloading system of claim 17 which further comprises a deflector positioned within the deflector housing and secured between the first and second ends thereof, the deflector being provided with a first side and a second side, the first side extending generally upwardly and towards the opposed second side of the deflector housing and the second side extending generally upwardly and towards the first side of the deflector housing, the first and second sides of the deflector converging at their upwardly extending end portions to form a ridge, the first and second sides of the deflector being positioned so that the lower end portions of the first and second sides are disposed within a space formed between the lower side of the body of the traversing car and the first horizontal partition wall of the storage assembly near the first and second openings in the first partition wall, the ridge formed by the upper portions of the first and second sides being positioned on a level near the uppermost portion of the deflector housing.

19. The unloading system of claim 18 which further comprises a housing cover having an opening formed through a medial portion thereof, the housing cover being secured to the upper portions of the first and second sides of the deflector housing to substantially cover the deflector housing and so that the opening in the housing cover communicates with the opening of the deflector housing.

20. The unloading system of claim 19 which further comprises:

a neck member having a lower end portion and an upper portion; and a peripherial flange formed at the upper portion of the neck member, the neck member being connected to the housing cover through the lower end portion thereof so that the neck member is positioned over the opening formed through the housing cover, and wherein the neck member is further provided with a passageway extending therethrough, the neck member being secured to the housing cover so that the passageway formed in the neck member is in communication with the opening formed in the housing cover.

21. The unloading system of claim 20 which further comprises:

a plurality of upper roller support members secured to the upper side of the housing cover so that the upper roller support members are maintained in a parallel, spaced apart relationship and are disposed on each side of the neck member;

a plurality of lower roller support members secured to the lower side of the body of the traversing car; and a plurality of belt rollers, the belt rollers being journally supported by the upper and lower roller support members, each upper roller support member being further characterized as having a generally plate-like structure and extending perpendicularly upward a distance from the upper side of the housing cover from near the first end of the deflector housing to near the second end of the deflector housing.

22. The unloading system of claim 21 wherein the belt roller secured to the lower roller supports is aligned in an off-set relationship with one of the belt rollers supported by an upper roller support member.

23. The unloading system of claim 22 wherein the traversing car is further provided with a belt slot formed through the upper side and the opposed lower side of the body of the traversing car, the belt slot being generally positioned between each upper and lower belt roller.

24. The unloading system of claim 23 wherein four belt slots are formed through the body of the traversing car, two being positioned near the first side of the body in close proximity to the first side of the deflector housing and two being positioned in the opposed second side near the opposed second side of the deflector housing.

25. The unloading system of claim 24 wherein a medial portion of the first seal belt is substantially threaded between the upper and lower belt rollers and two of the belt slots positioned within the body of the traversing car, and a medial portion of the second seal belt is substantially threaded between the upper and lower belt rollers and two of the belt slots positioned in the body of the traversing car near the second side of the deflector housing, the first and second seal belts cooperating so that the first and second openings in the first partition wall are substantially continuously covered by the first and second seal belts or the housing cover while enabling the traversing car to move along the track assembly.

26. The unloading system of claim 25 wherein the material receiving chute is provided with a lower first end an an opposed upper second end, a first side, a second side, a third side, and a fourth side, the first, second, third and fourth sides being interconnected so as to form a chute having a box-like configuration which has a generally rectangular shaped opening extending therethrough, the lower first end of the chute being supported upon and connected to the flange of the neck member by the load absorbing spring so that the rectangular shaped opening of the chute cooperates with the passageway of the neck member and the opening of the housing cover to form a flow channel therethrough.

27. The unloading system of claim 26 wherein the lower first end of the chute is further provided with a flange member and the flange member of the chute is connected to the flange of the neck member.

28. The unloading system of claim 27 wherein the opposed upper second end of the material receiving chute diverges generally upwardly and outwardly from a medial portion of the chute, the opposed upper second end of the chute extending a distance upwardly and out of the upper second chamber of the storage assembly through the opening therein a distance sufficient for operable engagement with the storage bin of the vehicle.

29. The unloading system of claim 28 wherein the material receiving chute further comprises:

a first side plate and an opposed second side plate, the first and second side plates being positioned so as to be on opposite side portions of the rectangularly shaped opening of the chute, the first and second side plates being secured to the upper portion of the chute so as to substantially diverge upwardly and outwardly and extend generally between the first and third side of the chute.

30. The unloading system of claim 29 which further includes:

a plurality of first guide arms operably connected to the first and opposed second side plates of the material receiving chute so as to be disposed within the rectangularly shaped opening of the chute, the first guide arm being positioned in a spaced-apart relationship from near the first side of the chute to near the opposed third side of the chute; and a plurality of second guide arms operably connected to the first and second side plates and extending into the rectangularly shaped opening of the chute.

31. The unloading system of claim 30 wherein each of the first guide arms is generally curved and has an enlarged first end, an opposed second end, and a generally straight and horizontally disposed portion between the first end and the opposed second end, the first end of each of the first guide arms being connected to the first or second side plate so that the second end of the respective first guide arm extends a distance from the first end and is positioned above the rectangularly shaped opening of the chute, each of the first guide arms generally curving upwardly from the first end thereof and extending into the environment surrounding the unloading station, the straight portion of each of the first guide arms being disposed adjacent the curved portion of an adjacent first guide arm or one of the second guide arms so that in a first position of the first guide arms the straight portion of the first guide arms substantially form a horizontal guide surface positioned at a predetermined level above the storage assembly; and wherein each of the second guide arms is provided with an enlarged first end and an opposed second end, the first end of each of the second guide arms being connected to the first or second side plates of the chute so that the opposed second end is positioned and spaced generally above the rectangularly shaped opening of the chute, the second guide arms being positioned so that the second guide arms curve generally upwardly from the first end thereof to the level of the straight portions of the first guide arms, the second end of each of the second guide arms curving downwardly towards the rectangularly shaped opening of the chute in a direction towards the opening of the chute.

32. The unloading system of claim 31 wherein each of the first guide arms is provided with a guide member connected to an upper portion thereof, each guide member generally following the curvature of its respective guide arm and each guide member cooperating to form a guide slot.

33. The unloading system of claim 32 wherein the vehicle is a railroad car and railroad tracks are positioned over the storage assembly so that the opening in the upper second chamber is positioned between the railroad tracks.

34. The unloading system of claim 33 wherein the railroad car comprises:

a body, a first truck, a second truck, a first and second load absorber, a plurality of wheels and a plurality of axles, the body being semi-rigidly supported on the first and second trucks by the first and a second load absorber, the first and second trucks being positioned upon the railroad tracks for rolling movement of the body by the plurality of wheels which are journally supported by the plurality of axles operably connected to the first and second trucks.

35. The unloading system of claim 34 wherein:

the body of the railroad car is provided with a first side, an opposite second side, a first end wall, a second end wall, a ceiling and a floor, the first and second ends, the first side, the second side, the ceiling, and the floor cooperating to form the storage bin, and wherein the floor comprises:

a first side floor member and a second side floor member, the first and second side floor members extending between the first end wall and the second end wall of the body, the first side floor member being connected to a lower portion of the first side of the body and the second side floor member being connected to a lower portion of the second side of the body so that the first and second side floor member slope downwardly from the first and second sides in a near converging manner to form a floor opening therein which is in communication with the storage bin;

a plurality of first floor plates secured to the lower end portions of the first and second side floor members from near the first end wall to near the second end wall of the body, each first floor plate having a first end, an upper second end, a first side and an opposite second side, the upper second end of each first floor plate extending generally upwardly and disposed within a lower portion of the storage bin;

a plurality of second floor plates, each second floor plate having an upper first side, a lower second side, a first end, and an opposed second end, the upper first side of each second floor plate being connected to the upper second end of one of the first floor plates so as to form a ridge and so that the second floor plate extends a distance downwardly therefrom, each of the second floor plates near the first and second ends of the body being secured to the first and second side floor members, the first floor plates, and the second floor plates cooperating to substantially enclose the space formed between the lower portions of the first and second side floor members and to define a discharge opening therebetween, the discharge openings generally facing towards the second end of the body;

a plurality of closure gates, each of the closure gates being pivotally connected to one of the second floor plates at a position adjacent the respective discharge openings so that the discharge opening is covered by one of the closure gates when the gate is in a closed first position and the discharge opening is uncovered when the closure gate is in an open second position; and a plurality of latch assemblies, one of each latch assembly being operably connected to each closure gate, the latch assembly maintaining the closure gate in the closed first position when the latch assembly is in a locked position and when the latch assembly is an unlocked position the respective closure gate can be moved from the closed first position to the open second position thereby exposing one of the discharge openings to the surrounding environment, the latch assemblies and enclosure gates being progressively moved from the locked and closed first position to the unlocked and open second position by operable engagement with the traversing car.

36. The unloading system of claim 35 wherein each closure gate generally comprises:

a cover plate, a plurality of backing ribs, a pair of side plates and a first supportive shaft, the cover plate being generally rectangularly shaped and sized to cover one of the discharge openings, the first supportive shaft being horizontally disposed and connected to the first and second side floor members, the backing ribs being connected to the first support shaft and the cover plate being secured to the backing ribs.

37. The unloading system of claim 36 wherein the first floor plate is provided with a lip near the first end thereof so that the latching assembly operatively engages the lip of the first floor plate when the latching assembly is in a locked position and wherein the latching assembly comprises:

two lever arms, two guide wheels, two bar clamps, two seal plates, a seal flap, two second support shafts, and a third support shaft, each of the second support shafts interconnecting one lever arm, one backing rib and one bar clamp, the lever arm being connected to the second support shaft so that the lever arm is positioned generally outwardly from the backing rib, the third support shaft interconnecting the two lever arms and the two bar clamps, the third support shaft further being operatively connected to each guide wheel so that one of the guide wheels is journally connected to each lever arm and is positioned outwardly from the associated lever arm, the seal plates are operatively connected to the bar clamps and the seal plate is connected to the two bar clamps and extends from one side plate to the opposed side plate.

38. The unloading system of claim 37 wherein each bar clamp is provided with a hooked first end, a curved second end, and a concave portion, and each bar clamp is positioned near an inwardly facing portion of one of the backing ribs and is connected to an adjacent lever arm by a shaft so that the concave portion of each bar clamp rests upon an end portion of one of the second support shafts when the latch assembly is in a locked position and each bar clamp is engaged with one of the lips of the latch assembly.

39. The unloading system of claim 38 wherein the lip of each floor plate is further provided with a convex portion, each seal plate is provided with a concave portion and wherein two bar clamps, two seal plates and one seal flap form a clamping assembly and in the closed position of the latching assembly the concave portion of the seal plates are seated with the convex portion of the lip on the adjacent first floor plate.

* * * * *